United States Patent [19]

Cisek et al.

[11] Patent Number: 4,477,950

[45] Date of Patent: Oct. 23, 1984

[54] CLOSURE

[75] Inventors: Kenneth E. Cisek; Ewald A. Kamp, both of Chicago, Ill.

[73] Assignee: Union Carbide Corporation, Old Ridgebury, Conn.

[21] Appl. No.: 444,979

[22] Filed: Nov. 29, 1982

[51] Int. Cl.[3] ..... B65D 63/00; B65D 77/10

[52] U.S. Cl. ..... 24/30.5 P; 24/16 PB; 24/17 AP; 24/30.5 S; 24/130

[58] Field of Search ..... 24/16 R, 16 PB, 17 A, 24/17 AP, 30.5 R, 30.5 P, 30.5 S, 30.5 L, 30.5 T, 130; 248/74.5

[56] References Cited

U.S. PATENT DOCUMENTS

| | | | |
|---|---|---|---|
| 1,926,359 | 9/1933 | Anthony | 24/17 A |
| 2,361,506 | 10/1944 | Smith | 24/17 AP |
| 3,224,054 | 12/1965 | Lige | 248/74 PB |
| 3,744,094 | 7/1973 | Bach | 24/30.5 |
| 3,837,101 | 9/1974 | Young | 24/17 AP |
| 4,077,562 | 3/1978 | Ballin | 24/30.5 P |

FOREIGN PATENT DOCUMENTS

| | | | |
|---|---|---|---|
| 1086297 | 2/1955 | France | 24/16 PB |
| 1529120 | 6/1968 | France | 24/30.5 P |
| 12577 | of 1915 | United Kingdom | 24/17 A |
| 1108514 | 4/1968 | United Kingdom | 24/16 PB |
| 1201483 | 8/1970 | United Kingdom | 24/16 PB |

*Primary Examiner*—Victor N. Sakran

*Attorney, Agent, or Firm*—James L. Sonntag

[57] ABSTRACT

Disclosed is a closure having an aperture at one end and projections on its edges that is improved by the use of slits, either extending from the aperture or extending from the abutment edges of the projections, which provide a locking action that prevents release of the closure when under elongation load through curling and deformation of the strip.

16 Claims, 16 Drawing Figures

PRIOR ART
FIG. 8
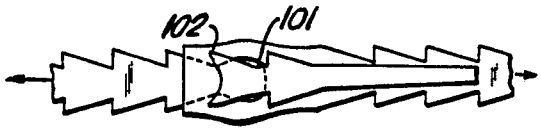
FIG. 9a
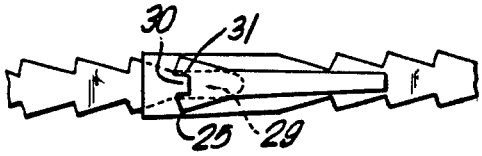
FIG. 9b
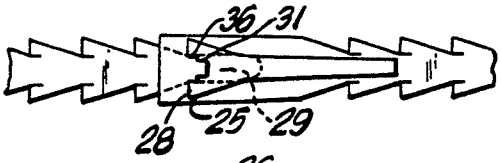
FIG. 9c
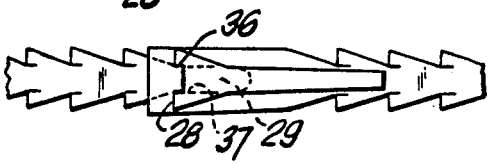
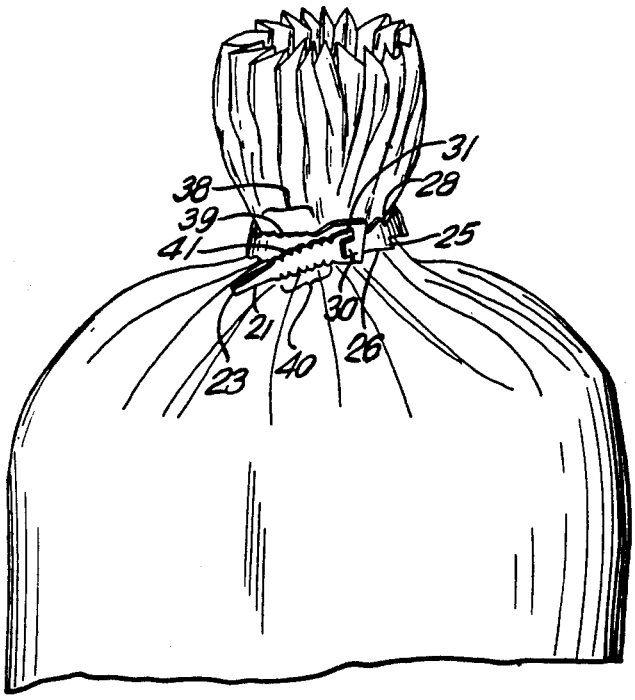
FIG. 10

CLOSURE

The present invention relates to closure or ties used to secure the twisted or gathered neck of bags, secure bundles of wires or cable, and to attach tags or labels.

Many "tie strips" or closures are known. These range from simple insulated soft iron wires, commonly known as "twist ties" to three dimensional plastic injection moldings with metal inserts. Many of these closures are fairly easy to use, inexpensive, and provide a good secure closure. It is frequently desirable, particularly for use with large disposer, "garbage" or "trash" bags, that the closure formed be of a material that is compatible with the bag material in order to facilitate salvage of the plastic materials. As an example, there are closures in use made from stampings from polyethylene sheets. These are relatively inexpensive and are compatible with the material of the bags used. One of the more frequently used closures is substantially the same as that disclosed in U.S. Pat. No. 3,780,921, issued Dec. 25, 1973 to Harry J. Harp. This closure (prior art-type) is generally described therein as a closure having at one end an aperture, generally rectangular, the other end of the closure being of such shape and size as to enable it to be passed through the aperture. Intermediate the ends of the closure is a zone of projections along the longitudinal edges of the closure, formed in such a way as to provide a series of arrow-head like projections, which also must pass through the aperture.

To secure a bag, the prior art-type closure is placed around the gathered or twisted neck of the bag, the end opposite the aperture is then inserted through the aperture and advanced so that the projections of the closure engage the peripheral edge of the aperture and lock the closure when the closure is tensioned and a projection reaches the end of the aperture. This prior art-type closure performs well when stamped from a relatively thick low density polyethylene sheet. However, when the sheet thickness is reduced there is a shortcoming when the locked closure is subjected to a high elongation load; in that the perimeter of the aperture and the projections tend to curl up and/or deflect, thereby allowing disengagement of the projections from the aperture and release of the closure. Thus, the prior art-type closure must be made from relatively thick and stiff sheet stock, typically of low or medium density polyethylene having a thickness of about 0.84 mm (0.33 in) or more.

It would be desirable to form prior art-type closures of sheet stock of thinner but stronger materials, such as high density polyethylenes that have a higher tensile strength. The use of these materials would provide a thinner more flexible closure that would be easier for the consumer to use. In the cutting operation, the thinner sheet stock would also cause less wear on the cutting blades and the other machinery used to make the closure, while the higher tensile strength of high density polyethylene would perform the same or better than closures made from the thicker low density polyethylene. Also a sizable material savings could be achieved by use of the thinner material. However, it has been found that a prior art-type closure, when made from thin high-density polyethylene sheet stock, releases (i.e. opens and comes apart) at unsuitably low elongation loads due to the above described deflections and curling. The instant invention is intended to overcome this defect.

An object of this invention is to provide a closure that is economical to make and easy to use, such as the above described prior art-type closure, but which can be made from thinner materials, such as thin high-density polyethylene sheet stock.

Another object of the invention is to provide a closure that forms a firm locking action when applied around the neck of a bag and will not release under elongation load due to curling and deformation of the closure. By "elongation load" is meant a loading on the closure that tends to elongate the closure in the longitudinal direction and that results by virtue of the closure being tightly wrapped around and secured to the twisted or gathered neck of a bag.

Other objects of this invention will become apparent in the description of the invention below.

The invention in its broadest aspect comprehends a closure comprising an elongated, pliable, resilient strip, having a first end, a leader end, two longitudinal edges between the first end and the leader end, and a longitudinal axis extending between the longitudinal edges; said strip having in a first zone on each longitudinal edge at least one projection defined by an edge portion oblique to the longitudinal axis and an abutment edge portion intersecting the oblique edge portion, said oblique and abutment edge portions on each longitudinal edge being respectively transversely aligned opposite the edge portions of the opposite longitudinal edge relative to the longitudinal axis so as to cooperatively form at least one arrow-head shape with the oblique edge portions converging towards the leader end; said strip having an aperture intermediate the first end and the first zone, and said strip having at least one pair of substantially longitudinally extending slits one slit of each pair being transversely aligned opposite the other slit relative to the longitudinal axis such that a portion of the slit will engage a portion of the strip to provide a locking action when the leader end and at least one opposing pair of abutment edge portions are passed through the aperture and the strip is subjected to an elongation load. The longitudinal edges of the strip at the leader portion may be substantially parallel or may converge towards each other as the edges approach the leader end.

Another aspect of the invention includes a closure as described above wherein a pair of slits extend from the aperture towards the first end such that a slit engages an abutment edge portion to provide a locking action when the leader end and at least one opposing pair of abutment edge portions are passed through the aperture and the strip is subjected to an elongation load. Preferably the slits extending from the aperture are substantially parallel to the longitudinal axis.

Another aspect of the invention includes a closure as described broadly above wherein a series of paired opposing slits extend from the abutment edge portions towards the leader end such that a slit engages the edges of the aperture to provide a locking action when the leader end and at least one opposing pair of abutment edge portions are passed through the aperture and the strip is subjected to an elongation load. Preferably the portion of each of the paired opposing slits nearest the abutment edge portion is an extension of the oblique edge portion.

Another aspect of the invention includes a closure, as described broadly above wherein a pair of slits extend from the aperture towards the first end; and a series of paired opposing slits extend from the abutment edge portions towards the leader end; such that a slit extending from the aperture engages a slit extending from the abutment edge portions to provide a locking action when the leader end and at least one opposing pair of abutment edge portions are passed through the aperture and the strip is subjected to an elongation load. Preferably the portion of each of the paired opposing slits nearest the abutment edge portion is an extension of the oblique edge portion and the slits extending from the aperture are substantially parallel to the longitudinal axis.

Another aspect of the invention includes any of the above described closures additionally having in a second zone along the longitudinal edges between the aperture and the first zone, a series of serrations or anti-slip teeth adapted to catch the gathered material of a bag to which the closure is applied in order to prevent slippage of the closure along the gathered bag material. Optionally this closure having the anti-slip teeth additionally has in a third zone between the leader end and the first zone, a series of serrations such that said closure is complementary with an adjacent identical closure when the longitudinal axes of the closures are parallel and the first end of said closure is adjacent to the leader end of the adjacent closure, such that a gang of closures may exist together in a complementary set. The serrations of the second zone may be optionally pointed and the serrations of the third zone would be, therefore, rounded.

It has been found that a closure can be made from thin, flexible materials such that curling and deformation of the closure under an elongation load does not cause release of the closure. This is accomplished by providing slits, which can either extend from the aperture or from the abutment edge portions, or both. Through the closures of the invention it is possible to take full advantage of the tensile strength of the material used, allowing for the use of thinner more flexible sheet materials for closure formation.

In one embodiment of the closure of the invention, slits are extended from the aperture, forming a "flap" or a tab so arranged that when the closure is engaged and under elongation load the slits cooperate with the projections of the closure such that the tab overlays the closure upon its longitudinal axis, minimizing the opportunity for the projections of the closure to curl up and pull through the aperture.

In another embodiment, slits are provided in the abutment edge portions of the closure, there being no slits extending from the aperture. When a closure of this embodiment of the invention is engaged and under elongation load the slits in the projections engage the sides of the aperture to provide an interlocking action such that the curling of the projections and bowing out of the sides of the aperture is minimized.

In yet another embodiment of the invention, a closure is provided with slits extending from the aperture, and additionally with slits in the abutment edge portions of the closure. When a closure of this embodiment is engaged and under elongation load the slits extending from the aperture cooperate with the slits extending from the abutment edges to provide an interlocking action which inhibits bowing out of the sides of the aperture and the curling of the projections, thereby preventing release and opening of the closure.

The invention includes closures with slits extending from the aperture, slits extending from the abutment edge portions, or slits in both places. Thus, through the action of slits, whether extending from the aperture or from the abutment edge portion, the above-described curling and deformation of the closure is minimized and its resistance to pull out or separation is increased. The strength of the closure action is thus limited only by the tensile strength of the material used to make the closure, not by the engagement itself. Thus, it is possible to use thinner materials of manufacture to make the closures of the invention. Typically a closure of the invention can be made from high density polyethylene stock that is less than about one-half the thickness of the low density polyethylene sheet stock that was necessary in the prior art-type closure. Since thinner materials may now be used, the closures of the invention are more flexible and are easier to use, particularly under adverse conditions of weather and temperature. The thinner material also reduces die pressure during manufacture and reduces the wear on the die. The thinner materials are less expensive if made from high density polyethylenes, and thus by practice of the invention, a great economic savings can be realized.

Another embodiment of the present invention includes additionally a series of relatively sharp laterally disposed teeth or serrations that prevent the closure from slipping by digging into the bag material. These serrations are in a zone on the longitudinal edges between the end having the aperture and the projections. In the use of large bags, the top of the bag is closed by twisting the top into a "neck" and applying the closure. Since bags are often carried by the neck, the neck stretches and narrows which causes the closure to loosen, and thereby allows the closure to slide along the neck. The user is then forced to retighten the closure or to apply the closure a second time. The serrations inhibits the sliding action of the closure when the neck is stretched.

Referring to the drawings.

FIGS. 4(*a*) to 4(*d*) are plan views of further differing embodiments of the closure of the invention.

Figure 5:
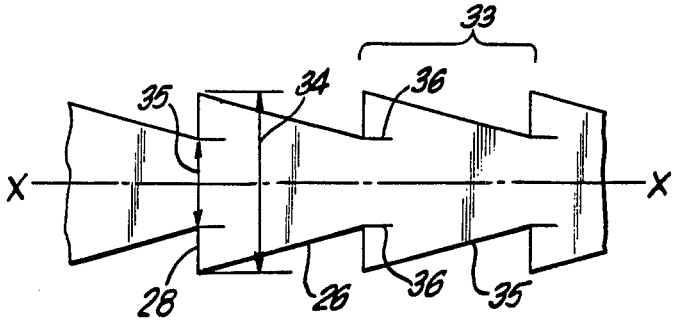

FIG. 5 is a plan view of a portion of the first zone of the closure of FIGS. 4(*c*) or 4(*d*).

Figure 3:
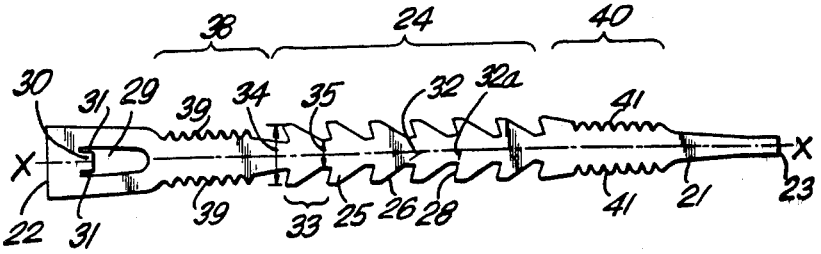
FIG. 3 is a plan view of another embodiment of the closure of the invention showing anti-slip serrations on the lateral edges.
Figure 4A:
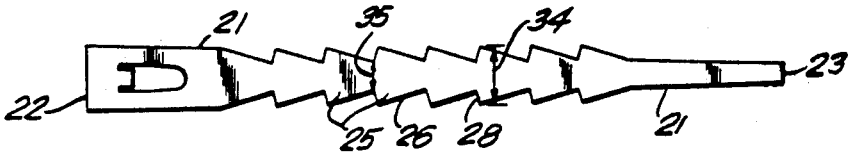
Figure 4B:
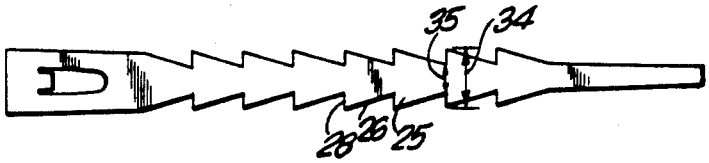
Figure 4C:
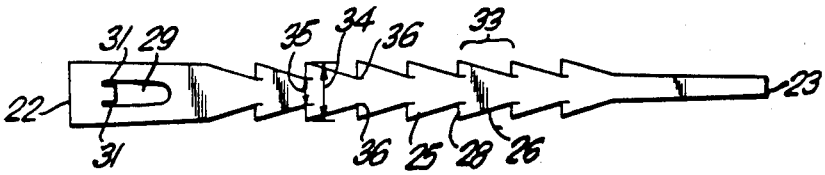
Figure 4D:
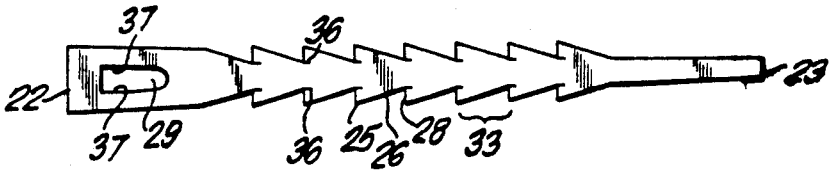
Figure 6:
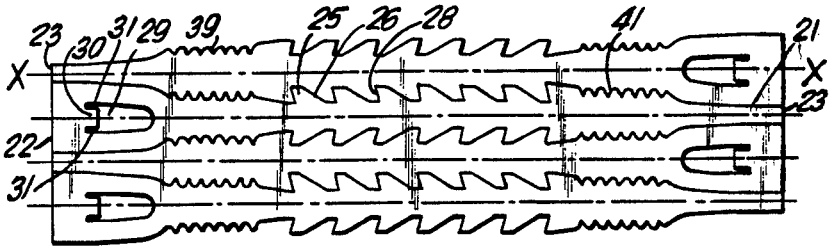

FIG. 6 is a plan view of a gang of complementary closures similar to the closure of FIG. 3.

Figure 7A:
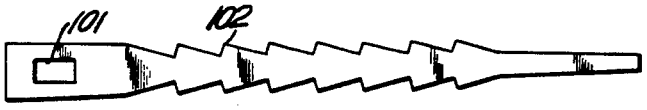
PRIOR ART FIG.7a
Figure 7B:
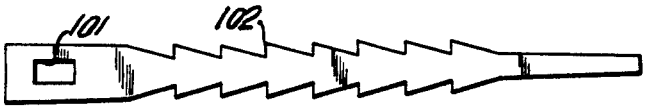
PRIOR ART FIG.7b

FIGS. 7(*a*) and 7(*b*) are plan views of prior art-type closures.

FIG. 8 is a view of a prior art-type closure similar to the closure of FIG. 7(*a*) or 7(*b*) under elongation load.

FIGS. 9(*a*), and 9(*b*), and 9(*c*) are views of closures of the invention similar to the closure of FIGS. 4(*a*), 4(*c*), and 4(*d*), respectively, under elongation load, and showing the locking action provided by the closures of the invention.

FIG. 10 is a view of a closure similar to the closure of FIG. 3, applied to the neck of a loaded bag.

FIGS. 1, 2, 3, 4(*a*), 4(*b*), 4(*c*), 4(*d*), and 5 illustrate differing embodiments of the invention. These embodiments of the closure of the invention as illustrated by these figures comprise an elongated strip having longitudinal edges 21, a first end 22 and a leader end 23. The closure strip has in a first zone 24 on the longitudinal edges 21, a series of projections 25 formed by an edge portion 26 oblique to the longitudinal axis X—X and an abutment edge portion 28. The projections 25 on one longitudinal edge 21 are transversely aligned with the projections 25 that are on the longitudinal edge 21 on the opposite side of the longitudinal axis X—X so as to cooperatively form arrow-head shapes 33 with the oblique edge portions 26 coverging towards the leader end 23. The closures of the invention also have an aperture 29 intermediate the first end 22 and the arrow-head shapes 33 in the first zone 24.

Figure 1:
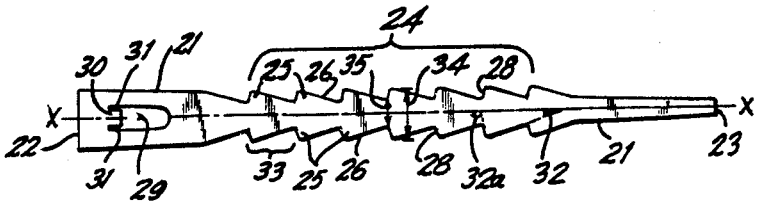
FIG. 1 is a plan view of a closure illustrating an embodiment of the invention.
Figure 2:
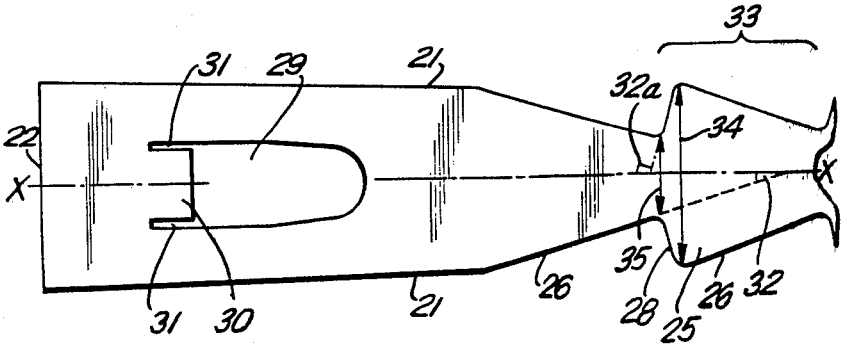
FIG. 2 is a plan view of the first end of the closure of FIG. 1.

The leader end 23 is dimensioned so that it may be passed through the aperture 29 without undue restraint, that is without the edges of the aperture 29 interfering or impeding the entrance or the passage or the leader end 23 through the aperture 29. The longitudinal edges 21 adjacent to the leader end 23 may be substantially parallel or may converge towards each other towards the leader end 23. The angle 32 of the oblique edge portion 26 to the longitudinal axis X—X is such that when the leader end 23 is pulled after inserting and pulling the leader end 23 through the aperture 29, the oblique edge portion 26 through a wedging action assists in reducing the force necessary to accomplish a passage through the aperture 29, such that the user is able to pull at least one pair of transversely aligned projections 25 through the aperture 29. The angle 32*a* between abutment edge portion 28 and the longitudinal axis X—X, which can be obtuse, acute or perpendicular to the longitudinal axis X—X, is such that it inhibits retraction of the closure and does not cause formation of a disabling curling and resulting wedging action that would defeat the locking action of the closure. FIGS. 1, 3 and 4(*a*) illustrate closures having angled abutment edge portions 28, and FIG. 4(*b*) illustrates a closure having perpendicular abutment edge portions 28.

FIGS. 1, 2, 3, 4(*a*), 4(*b*), 4(*c*) also have a tab 30 defined by two slits 31 extending approximately parallel to the longitudinal axis X—X from the aperture 29 towards the first end 22. These closures function to provide a locking action after the leader end 23 is inserted and pulled through the aperture and at least two opposing projections 25 (i.e. abutment edge portions 28) have been pulled through the aperture 29. The paired abutment edge portions 28 engage the ends of the slits 31 such that the portion of the closure pulled through the aperture 29 is inhibited from being retracted. Typically the slits 31 extend the same distance, such that the abutment edge portions 28 oppositely disposed from one another with respect to longitudinal axis X—X engage the slits 31 cocurrently. The length and width of the tab 30 should be such that it is stiff enough to prevent significant curling and bending of the projections 25 and the perimeter of the aperture 29. Preferably the slits 31 are substantially parallel to the longitudinal axis X—X.

FIGS. 4(*c*), 4(*d*) and 5 illustrate other embodiments of the invention wherein paired opposing slits 36 are formed in the abutment edge portions 28. FIG. 4(*c*) illustrates a closure with slits 31 extending from the aperture 29, as explained above, and also paired opposing slits 36 extending from the abutment edge portions 28. This closure is applied around the twisted or gathered neck of a bag as described above. When the closure is engaged and under elongation load the paired slits 31 extending from the aperture 29 and the paired slits 36 in the projections 25 interact to provide a locking action, which minimizes deformation of the aperture 29 perimeter and the projections 25, thus precluding the closure release.

FIG. 4(*d*) illustrates a closure with the paired slits 36 extending from the abutment edge portions 28 but lacking the slits extending from the aperture 29. This closure is applied around the twisted or gathered neck of a bag as described above. When the closure is engaged and under elongation load the paired slits 36 interlock with the edges 37 of the aperture 29 to provide a locking action, which minimizes deformation of the aperture 29 perimeter and the projections 25, thus precluding the closure release.

The width across the base 34 and the narrow neck 35 of the arrow-head shaped portions 33 are such that the closure can engage, as described herein, without causing curling of the projections 25 or excessive bending the aperture 29 perimeter. Typically the narrow neck 35 is slightly narrower than the width of the aperture 29 and the width of the base 34 is wider than the width of the aperture 29.

Still another embodiment of the invention is illustrated by FIGS. 3 and 6. In FIG. 3 is shown a closure that additionally includes a second or anti-slip zone 38, intermediate first end 22 and the first zone 24, having a series of serrations 39 longitudinally spaced on the outer edges 21 adapted to catch the material of the bag when the closure is in use and prevent the closure from sliding along or from the twisted or gathered bag neck. Optionally a third zone 40 is also provided intermediate the leader end 23 and the first zone 24 having a series of complementary serrations 41, adapted to complement the anti-slip serrations 39 of a transversely continuous adjacent closure, i.e. the closure is complementary with an adjacent identical closure when the longitudinal axes of the closures are parallel and the first end 22 of the closure is adjacent to the leader end 23 of the adjacent closure. The complementary serrations 41 are provided when it is desirable to have a multiplicity of closures in a gang that have anti-slip serrations 39, as is illustrated in FIG. 6.

The closures of the invention can be manufactured by any suitable method, such as cutting from a sheet using cutters, knives, stamps or dies, or by injection molding methods, or the like. The preferred method and apparatus to make the closures of the invention is disclosed in the above cited U.S. Pat. No. 3,780,921. Therein is disclosed a method of producing a gang of elongated apertured articles separable connected along their longitudinal edges, which method comprises providing a web or sheet of material, preferably in a roll; advancing said web to a scoring station; scoring said web to outline in said web the longitudinal edges and apertures of each of said articles without removing said articles and apertures from said web; then removing material from each of said outlined apertures in each of said articles in said web to produce in each the desired aperture; applying a pulling force to said web through apertures so formed; advancing said web to a severing station; and severing said web into a plurality of portions each containing an interconnected gang of said articles of predetermined number. The slits in the closures of the invention are formed when the outlines of the longitudinal edges and the aperture are scored in the web. The severed portions are stacked in a shingled array for delivery to a packaging station. The word "score" in its various forms refers to cutting through the thickness of the material.

The apparatus disclosed in the above referenced U.S. Pat. No. 3,780,921 comprises an apparatus for continuously producing a plurality of gangs of separably interconnected elongated articles, such as the closures of the invention, from a continuous web of material, which apparatus comprises a support for a supply of said web material; a scoring station having a plurality of dies and a platen for scoring in said web the outline of the closure and of an aperture therein; means for advancing said web to said die-scoring station between said dies and said platen; a material knock-out station removed from said scoring station for removing material from said web in areas scored for said apertures; means for advancing said web to said knock-out station; a web-severing station removed from said material knock-out station; and means, such as a sprocketed roll for engagement with apertures produced at said knock-out station, to advance said web to said web severing station. The dies used for scoring the outline of the closure and the aperture are constructed so as to form the slits at the scoring station.

When the preferred method for making the invention is used, the closures are interconnected in the form of a gang and each closure is delineated by scores impressed in the web of material. Preferably the closures are arranged transverse to the longitudinal axis of the web. The width of the web corresponds to the length of the closure multiplied by an integer, preferably one. If the integer is more than one the web is split before the severing step. As arranged in the web, the longitudinal edge of each closure is complementary of each of its neighbors. Thus, one series of scores in the transverse arrangement across the width of the web defines edges of two closures and the apertures of the closures are situated near opposite marginal edges of the web. The scores defining the edges of the closures are interrupted or discontinuous at at least one location across the web, preferably at several locations, to provide a continuous connection of material along the length of the web so that the closures remain connected until it is desired to separate them.

FIG. 6 is a plan view of a gang of four closures of the invention as made by method of U.S. Pat. No. 3,780,921. FIG. 3 shows such a closure after separation from the gang. In order that adjacent closures can be interconnected and be complementary of its neighbors, the third zone 40 of serrations 41 is provided, to nest or complement with the anti-slip serrations 39 in the second zone 38 of a neighboring identical closure. It is preferable that the points of the serrations 39 of the anti-slip or second zone 38 be pointed and the serrations 41 of the complementary or third zone 40 have rounded points, as is illustrated in FIGS. 3 and 6. The sharp pointed anti-slip serrations 39, which are around the neck of the bag when the closure is in use, provide for an aggressive interference action with respect to the slipping of the closure along or off of the neck of the bag, while the dull, rounded complementary serrations 41 are more comfortable for the user of the closure to grasp as he is applying it to the bag. These complementary serrations 41, since they are not around the neck of the bag when the closure is used, are only a result of forming interconnecting complementary closures, as in FIG. 6. When a non-complementary closure having only a second zone 38 with anti-slip serrations 39 is desired, the third zone 40 with the complementary serrations 41 may be omitted. The anti-slip serrations 39 and the complementary serrations 41 may be provided in any manner that has the above described functions. For example, the longitudinal edges 21 of the closure strip at the third zone 40 may be shaped or tapered in such a manner so as to assist pulling the complementary serrations 41 of the third zone 40 through the aperture 29 during applications of the closure. Also, any of the serrations of the second zone 38 or the third zone 40 may vary in shape to ease the application of the closure to the bag or improve the grabbing action of the closure on the gathered or twisted neck of a bag.

FIG. 7(*a*) and 7(*b*) *illustrate closures of the prior art-type.*

FIG. 8 illustrates the curling of the projections and aperture deformation of a prior art-type closure, such as those illustrated in FIGS. 7(*a*) and 7(*b*), when subjected to elongation load. As seen in FIG. 8, the forces resulting from the elongation load have caused the aperture 101 to bow out and the projections 102 to curl up. Under sufficient elongation load, the bowing out of the aperture 101 and the curling up of the projections 102 will eventually cause the projections 102 to pass back through the aperture 101, resulting in failure of the engagement. When using thinner, more flexible materials, this failure occurs at an unsuitably low elongation load. It is, therefore, necessary, to make these prior art-type closures stiffer by the use of thicker materials.

FIGS. 9(*a*), 9(*b*) and 9(*c*) illustrate the locking action of the closures of the invention. Shown is the engagement of closures of the invention, similar to those illustrated in FIGS. 4(*a*), 4(*c*) and 4(*d*), respectively, under elongation load. In FIG. 9(*a*) the projections 25 are engaged in slits 31 that define the tab 30, providing a locking action or an engagement which minimizes the opportunity for the perimeter of the aperture 29 to bow out, or the projections 25 to curl up. In FIG. 9(*b*) the slits 36 in the abutment edge portions 28 are engaged in slits 31 that extend from the aperture 29, providing a locking action or an engagement which minimizes the opportunity for the perimeter of the aperture 29 to bow out, or the projections 25 curl up. In FIG. 9(*c*) the slits 36 in the abutment edge portions 28 engage with the edges 37 of the aperture 29, providing a locking action or an engagement which minimizes the opportunity for the perimeter of the aperture 29 to bow out, or the projections to 25 curl up.

Since the above described curling and deformation is minimized when the closures of the invention are under a high elongation load, they do not disengage, as the prior art closures are prone to do when the stock material is too thin or too flexible. The strength of the closure is then limited only by the tensile strength of the material used. This allows for the use of thinner more flexible materials. A preferred material is high density polyethylene sheet of a thickness from about 0.25 mm (0.010 in) to about 0.46 mm (0.018 in). The preferred high-density polyethylene polymers typically have a density between about 0.94 to about 0.96 grams per cubic centimeter, and have a tensile strength between about 30 and about 40 kilo-Pascals (4 to 6 psi). Preferably the high-density polyethylene has a high resistance to splitting in the machine direction when it is formed into sheets. Prior art-type closures, similar to those illustrated in FIGS. 7(*a*) and 7(*b*), when made from this material, become disengaged under a relatively small elongation load. Using the closure of the invention, it is now possible to use this thin, flexible material and take advantage of its high tensile strength. Since a thinner material may be used to make the closures of the invention, a significant saving in the cost of the material may be realized.

Generally the material of manufacture can be any resilient material including suitable resilient metals and any of the suitable organic polymeric resins. These include polyethylene, polypropylene, polyvinyl chloride, polystyrene and the like. The preferred material of construction is polyethylene, polypropylene, or nylon. A particularly preferred material of construction is a high density polyethylene sheet of about 0.25 mm (0.01 in) to about 0.46 mm (0.018 in) thick, as described above. For use with food storage bags, a material in the lower thickness range is desirable, whereas for use with large garbage-type bags, a material in the higher thickness range is desirable.

The dimensions of the closure depend on the intended use. For closures used for very large garbage bags and the like, the closure can be about 15 cm (6 in) long and be proportioned as shown in FIG. 1 or 3. For smaller bags the closure can be proportionately smaller. If a very long closure is needed, two or more closures may be connected together longitudinally. As an example of an embodiment of the closure of the invention for use in garbage bags, refer to FIG. 1. For use on garbage bags and the like the closure of FIG. 1 would be about 13 cm (5 in) long, about 1.2 cm (15/32 in) wide at the first end 22, and about 0.4 cm (5/32 in) wide at the leader end 23. The first zone 24 would begin about 2.5 cm (1 in) from the first end 22 and be about 7.6 cm (3 in) long. There would be about seven projections 25 on each lateral edge about 0.95 cm (⅜ in) apart from each other. The width across the narrow neck portion 35 and the base 34 would be about 0.5 cm (3/16 in) and 1.0 cm (13/32 in) respectively. The aperture 29 would be about 0.9 cm (11/32 in) from the first end 22, be about 0.5 cm (3/16 in) wide and about 0.2 cm (1/16 in) long, and be equidistant from the lateral edges 21. The slits 31 would extend a distance of about 0.24 cm (3/32 in) from the aperture 29. The material of construction would be high density polyethylene about 0.46 mm (0.018 in) thick.

The closure of the invention is used by positioning it around the gathered or twisted neck of a bag, pulling the leader end through the aperture and continued pulling of the leader end until at least one pair of opposing projections pass through the aperture to secure the closure tightly around the neck of the bag. FIG. 10 shows a closure similar to the closure of FIG. 3 applied to a bag. In this closure, the serrations 41 in the third zone 40, where the user grabs to apply the closure, are rounded and thus more comfortable to grasp. The serrations 39 in the second zone 38 are pointed and provide an anti-slipping action to the neck of the bag.

Although the closures of the invention are contemplated to be used principally with bags and the like, they can be equally applied in similar tying applications, such as tying wire bundles and the like. The closures can also be used for applying tags or labels to bags and the like.

Although the invention has been illustrated by the figures explained above, the invention is not intended to be limited thereby. Closures of the invention may also include other features known in the art to improve their physical properties or ease their manufacture. For example, it may be desirable to provide for abutment edge portions and oblique edge portions that are slightly curved, and/or to provide for a curved edge portion at the inner intersection of the abutment edge portion and the oblique edge portion. It may also be desirable to blunt the point of the projections, or provide stress relief holes at the end of the slits. These features can be included in a closure of the invention as long as the above described engagement is provided for.

The following examples are not intended to limit the invention in any way.

In the following examples closures were tested for effectiveness of the closure. The testing apparatus was an Instron Model TM, manufactured by Instron Engineering Corporation, Quincy, Mass., equipped with an integrator. The closures were subjected to a pull-apart test, and a simple tension test. The pull-apart test is accomplished by engaging two like closures together and attaching the free ends to the jaws of the testing apparatus and pulling on the closures until there is a failure. Several closures were tested for each test. The mean thickness of the sheet stock of construction was recorded. The average maximum tensile force (MTF) encountered during the test, the average percent of elongation before failure, and the average energy required to break or disengage the closures, were computed by use of the integrator. The energy is a rough measure of the toughness of the closure. The energy and the percent of elongation are also related to the nature of the failure of the closure. If the engagement releases before the breakage of the closure itself, the energy and the elongation will be lower. If, on the other hand, the material of construction of the closure fails before the closure disengages, this usually involves significantly more stretching of the closure (hence a larger percent elongation) and significantly more energy. The simple tension test is accomplished by placing the ends of a single closure in the jaws of the testing apparatus and pulling thereon until it fails.

EXAMPLE I

Samples of closures of the invention and closures of the prior art were made and tested. All the closures were about 12 mm (15/32 in) wide and about 127 mm (5 in) long. The closures of the prior art wire proportioned as illustrated in FIG. 7(*a*). Three slightly differing designs of closures of the invention were made. The three were proportioned as illustrated in FIGS. 4(*a*), 4(*b*), and 4(*c*). Each closure had 7 projections on each lateral edge, spaced about 0.95 mm (⅜ in), and were designated here as CA, CB, CC respectively, the prior art closures being designated as PA. The closures of the prior art were made of high pressure, polyethylene sheet having a density of about 0.926 grams per cubic centimeter and having an approximate thickness of about 0.84 mm (0.033 in). The closures of the invention were made of sheets of a high molecular weight polyethylene having a density of about 0.960 grams per cubic centimeter and having approximate thicknesses of about 0.46 mm (0.018 in) and 0.38 mm (0.015 in). The material used for the closures of the invention was substantially more flexible and the closures made therefrom were easier to use than the closures of the prior art made from the thicker material.

In Tables A and B are shown the mean thickness in millimeters and the maximum tensile force (MTF) in Newtons of the pull apart and the simple tension tests. The values shown are the average of values of multiple tests.

TABLE A

| | Pull Apart | |
|---|---|---|
| Closure | Thickness (mm) | MTF (Newtons) |
| PA | 0.866 | 44.3 |
| CA | 0.459 | 52.8 |

TABLE A-continued

| Closure | Pull Apart Thickness (mm) | MTF (Newtons) |
|---|---|---|
| CB | 0.386 | 45.3 |
| CC | 0.395 | 45.4 |

TABLE B

| Closure | Simple Tension Thickness (mm) | MTF (Newtons) |
|---|---|---|
| PA | 0.876 | 54.8 |
| CA | 0.464 | 56.9 |
| CB | 0.362 | 44.6 |

Comparing the data in Tables A and B it can be seen that the values of the pull-apart of the closures of the invention of approximately the same thickness are nearly the values of the simple tension, demonstrating that the full tensile strength of the material used was utilized. The prior art closure, however, shows a pull-apart significantly less than the simple tension, showing failure before full utilization of the tensile strength of the material used. It can also be seen how a thinner, more flexible material can be used that has equivalent tensile strength of the thicker material. The closures of the invention are more flexible, less expensive, but exhibit the strength of the stiffer, more expensive closures of the prior art. As can be seen by comparing the pull-apart, and the simple tension values, the closures of the invention have properties which are comparable to the prior art closures, notwithstanding the lesser thickness and the resulting increase in flexibility of the closures of the invention.

EXAMPLE II

Closures of the invention and of the prior art were made and tested. Each closure was of approximately the same thickness. Closures of the prior art and closures of the invention were made of high density polyethylene sheet. The prior art type closures and the closures of the invention were about 12.7 cm long and about 1.2 cm wide, and were proportioned as shown in FIGS. 7(*b*) and 4(*b*) respectively. Below in Table C are the mean thickness in mm, maximum tensile force (MTF) in Newtons, energy in Joules, and percent elongation for the closures tested. The values shown are the average of values of multiple tests.

TABLE C

| Comparison Tests | Closure | |
|---|---|---|
| | Prior Art | Invention |
| Thickness (mm) | 0.48 | 0.48 |
| MTF (Newtons) | 44.9 | 55.0 |
| Energy (Joules) | 0.27 | 2.54 |
| % Elong. | 18.9 | 120. |

As can be seen by the data in Table C, the maximum tensile force for the prior art closure is significantly less than that for the closure of the invention. This was due to an early disengagement of the prior-art closure as is reflected in the low energy and low elongation. The closure of the invention, however, did not disengage, but the polyethylene strip broke before disengatement, as is reflected by the high elongation and the high energy required to break the closure. The closure of the invention was able to use the entire tensile strength of the polyethylene, whereas, the closure of the prior art disengaged before the full strength of the polyethylene could be utilized.

We claim:

1. A closure comprising an elongated, pliable, resilient strip, having a first end, and leader end, two longitudinal edges between the first end and the leader end, and a longitudinal axis extending between the longitudinal edges; said strip having in a first zone on each longitudinal edge at least one projection defined by an edge portion oblique to the longitudinal axis and an abutment edge portion intersecting the oblique edge portion, said oblique and abutment edge portions on each longitudinal edge being respectively transversely aligned opposite the edge portions of the opposite longitudinal edge relative to the longitudinal axis so as to cooperatively form at least one arrow-head shape with the oblique edge portions converging towards the leader end; said strip having an aperture intermediate the first end and the first zone, and said strip having at least one pair of substantially longitudinally extending slits, wherein each of the slits of said pair is transversely aligned relative to the other slit of said pair and on opposite sides of the longitudinal axis, such that a portion of at least one slit of said pair engages a portion of the strip to provide a locking action when the leader end and at least one opposing pair of abutment edge portions are passed through the aperture and the strip is subjected to an elongation load.

2. The closure of claim 1 wherein the longitudinal edges of the strip adjacent to the leader end are substantially parallel.

3. The closure of claim 1 wherein the longitudinal edges of the strip adjacent to the leader end converge towards each other as the edges approach the leader end.

4. A closure as described in claim 1 wherein a pair of slits extend from the aperture towards the first end such that a slit engages an abutment edge portion to provide a locking action when the leader end and at least one opposing pair of abutment edge portions are passed through the aperture and the strip is subjected to an elongation load.

5. The closure as described in claim 4 wherein the slits are substantially parallel to the longitudinal axis.

6. A closure as described in claim 1 wherein a series of paired opposing slits extend from the abutment edge portions towards the leader end such that a slit engages the edges of the aperture to provide a locking action when the leader end and at least one opposing pair of abutment edge portions are passed through the aperture and the strip is subjected to an elongation load.

7. A closure as described in claim 6 wherein the paired opposing slits are an extension of the oblique edge portion.

8. A closure as in claim 1 additionally having in a second zone along the longitudinal edges between the aperture and the first zone, a series of serrations adapted to catch the gathered material of a bag to which the closure is applied in order to prevent slippage of the closure along the gathered bag material.

9. A closure as in claim 4 additionally having in a second zone along the longitudinal edges between the aperture and the first zone, a series of serrations adapted to catch the gathered material of a bag to which the closure is applied in order to prevent slippage of the closure along the gathered bag material.

10. A closure as in claim 9, additionally having in a third zone between the leader end and the first zone, a series of serrations such that said closure is complementary with an adjacent identical closure when the longitudinal axes of the closures are parallel and the first end of said closure is adjacent to the leader end of the adjacent closure.

11. A closure as in claim 10 wherein the serrations of the second zone are pointed and the serrations of the third zone are rounded.

12. A closure as in claim 10 wherein said closure exists in a set of more than one complementary closure.

13. In a closure comprising an elongated, pliable, resilient strip, having a first end, and leader end, two longitudinal edges between the first end and the leader end, and a longitudinal axis extending between the longitudinal edges; said strip having in a first zone on each longitudinal edge at least one projection defined by an edge portion oblique to the longitudinal axis and an abutment edge portion intersecting the oblique edge portion, said oblique and abutment edge portions on each longitudinal edge being respectively transversely aligned opposite the edge portions of the opposite longitudinal edge relative to the longitudinal axis so as to cooperatively form at least one arrow-head shape with the oblique edge portions converging towards the leader end; said strip having an aperture intermediate the first end and the first zone, the improvement wherein the strip has at least one pair of substantially longitudinally extending slits, wherein each of the slits of said pair is transversely aligned relative to the other slit of said pair and on opposite sides of the longitudinal axis, such that a portion of at least one slit of said pair engages a portion of the strip to provide a locking action when the leader end and at least one opposing pair of abutment edge portions are passed through the aperture and the strip is subjected to an elongation load.

14. A closure comprising an elongated, pliable, resilient strip, having a first end, and leader end, two longitudinal edges between the first end and the leader end, and a longitudinal axis extending between the longitudinal edges; said strip having in a first zone on each longitudinal edge at least one projection defined by an edge portion oblique to the longitudinal axis and an abutment edge portion intersecting the oblique edge portion, said oblique and abutment edge portions on each longitudinal edge being respectively transversely aligned opposite the edge portions of the opposite longitudinal edge relative to the longitudinal axis so as to cooperatively form at least one arrow-head shape with the oblique edge portions converging towards the leader end; said strip having an aperture intermediate the first end and the first zone, and a first pair of slits extending from the aperture towards the first end; and at least one second pair of slits extending from the abutment edge portions towards the leader end, wherein each of the slits of the first and second pairs are transversely aligned relative to the other slit of the same pair and on opposite sides of the longitudinal axis; such that at least one of the slits of the first pair engages at least one of the slits of the second pair to provide a locking action when the leader end and at least one opposing pair of abutment edge portions are passed through the aperture and the strip is subjected to and elongation load.

15. The closure of claim 1 wherein there is a plurality of longitudinally spaced arrow-head shapes.

16. The closure of claim 15 wherein the slits of the first pair are substantially parallel to the longitudinal axis, and the slits of the second pair are an extension of the oblique edge portion.

* * * * *

UNITED STATES PATENT AND TRADEMARK OFFICE

CERTIFICATE OF CORRECTION

PATENT NO. : 4,477,950

DATED : October 23, 1984

INVENTOR(S) : Kenneth E. Cisek, et al

It is certified that error appears in the above-identified patent and that said Letters Patent is hereby corrected as shown below:

Col. 1, line 48, "(0.33)" should be --(0.033 in)--;
Col. 11, line 64, "disengatement" should be --disengagement--.

Signed and Sealed this

*Sixth* Day of *August 1985*

[SEAL]

*Attest:*

DONALD J. QUIGG

*Attesting Officer*

*Acting Commissioner of Patents and Trademarks*